US008912991B2

(12) United States Patent
Kim et al.

(10) Patent No.: US 8,912,991 B2
(45) Date of Patent: Dec. 16, 2014

(54) LIQUID CRYSTAL DISPLAY AND DRIVING METHOD THEREOF

(75) Inventors: Jong-In Kim, Suwon-si (KR); Min-Wook Park, Asan-si (KR); Eun-Guk Lee, Seoul (KR); Young-Goo Song, Asan-si (KR); Kyoung-Tai Han, Asan-si (KR); Hyuk-Jin Kim, Asan-si (KR); Hak-Bum Choi, Asan-si (KR); Hyo-Seop Kim, Cheonan-si (KR)

(73) Assignee: Samsung Display Co., Ltd. (KR)

( * ) Notice: Subject to any disclaimer, the term of this patent is extended or adjusted under 35 U.S.C. 154(b) by 537 days.

(21) Appl. No.: 13/188,898

(22) Filed: Jul. 22, 2011

(65) Prior Publication Data

US 2012/0236222 A1 Sep. 20, 2012

(30) Foreign Application Priority Data

Mar. 14, 2011 (KR) ..... 10-2011-0022295

(51) Int. Cl.
*G09G 3/04* (2006.01)
*G09G 3/36* (2006.01)

(52) U.S. Cl.
CPC ..... *G09G 3/3659* (2013.01); *G09G 2300/0852* (2013.01); *G09G 2300/0426* (2013.01); *G09G 2300/0876* (2013.01); *G09G 2300/0447* (2013.01)
USPC ..... 345/87

(58) Field of Classification Search
CPC ..... G09G 3/3659; G09G 2300/0426; G09G 2300/0876; G09G 2300/0852; G09G 2300/0447
USPC ..... 345/87
See application file for complete search history.

(56) References Cited

U.S. PATENT DOCUMENTS

| | | | | |
|---|---|---|---|---|
| 8,362,988 | B2 * | 1/2013 | Hsieh et al. | 345/87 |
| 2006/0146242 | A1 | 7/2006 | Kim et al. | |
| 2009/0256985 | A1 | 10/2009 | Jung et al. | |
| 2009/0268112 | A1 * | 10/2009 | Lu et al. | 349/38 |
| 2010/0007810 | A1 | 1/2010 | Nakamura | |
| 2010/0066658 | A1 * | 3/2010 | Kim et al. | 345/98 |
| 2010/0177024 | A1 * | 7/2010 | Choi | 345/76 |

FOREIGN PATENT DOCUMENTS

| | | |
|---|---|---|
| JP | 2005250050 | 9/2005 |
| JP | 2008015512 | 1/2008 |
| JP | 2008309884 | 12/2008 |
| JP | 4336341 | 7/2009 |
| JP | 2009265615 | 11/2009 |
| JP | 2010020257 | 1/2010 |
| KR | 100738758 | 7/2007 |
| KR | 1020080019891 | 3/2008 |
| KR | 1020090095186 | 9/2009 |

(Continued)

*Primary Examiner* — Ariel Balaoing
(74) *Attorney, Agent, or Firm* — Cantor Colburn LLP

(57) ABSTRACT

A liquid crystal display includes: a first gate line; a first data line crossing the first gate line; a first switching element connected with the first gate line and the first data line; a second switching element connected with the first gate line and the first data line; a first liquid crystal capacitor connected with the first switching element; a second liquid crystal capacitor connected with the second switching element; a boost switching element which is turned on during a time period not overlapping a time period during which the first switching element is turned on; and a boost capacitor including a first terminal connected with the boost switching element and a second terminal connected with the first liquid crystal capacitor.

20 Claims, 14 Drawing Sheets

(56) References Cited

FOREIGN PATENT DOCUMENTS

| | | |
|---|---|---|
| KR | 1020090108928 | 10/2009 |
| KR | 1020090112087 | 10/2009 |
| KR | 1020090131190 | 12/2009 |
| KR | 1020100004769 | 1/2010 |
| KR | 1020100032677 | 3/2010 |
| KR | 100961941 | 5/2010 |

* cited by examiner

LIQUID CRYSTAL DISPLAY AND DRIVING METHOD THEREOF

This application claims priority to Korean Patent Application No. 10-2011-0022295, filed on Mar. 14, 2011, and all the benefits accruing therefrom under 35 U.S.C. §119 the contents of which in its entirety is herein incorporated by reference.

BACKGROUND OF THE INVENTION (a) Field of the Invention

Exemplary embodiments of the invention relate to a liquid crystal display and a driving method thereof.

(b) Description of the Related Art

A liquid crystal display, which is one of widely used types of flat panel display devices, generally includes field generating electrodes, such as a pixel electrode and a common electrode, and a liquid crystal layer. The liquid crystal display generates an electric field in the liquid crystal layer by applying voltage to the field generating electrodes, to determine orientations of liquid crystal molecules of the liquid crystal layer and control polarization of incident light, thereby displaying an image.

Among the liquid crystal display, a vertically aligned mode liquid crystal display, in which a longitudinal axis of the liquid crystal molecules is arranged to be substantially perpendicular to upper and lower panels when the electric field is not applied, has been widely used due to a high contrast ratio and effective implementation of a wide reference viewing angle thereof.

In the vertically aligned mode liquid crystal display, since side visibility is deteriorated compared to front visibility, a method in which one pixel is divided into two subpixels and voltages of two subpixels are different has been proposed to improve the deteriorated side visibility.

BRIEF SUMMARY OF THE INVENTION

Exemplary embodiments of the invention provide a liquid crystal display with improved side visibility and with increased transmittance without decreasing an aperture ratio thereof and a driving method thereof.

An exemplary embodiment of the invention provides a liquid crystal display including: a first gate line; a first data line crossing the first gate line; a first switching element connected with the first gate line and the first data line; a second switching element connected with the first gate line and the first data line; a first liquid crystal capacitor connected with the first switching element; a second liquid crystal capacitor connected with the second switching element; a boost switching element which is turned on during a time period not overlapping a time period during which the first switching element is turned on; and a boost capacitor including a first terminal connected with the boost switching element and a second terminal connected with the first liquid crystal capacitor.

Another exemplary embodiment of the invention provides a method for driving a liquid crystal display including: applying a first data voltage to a first liquid crystal capacitor and a second liquid crystal capacitor of the liquid crystal display by turning on a first switching element and a second switching element of the liquid crystal display; and applying a second data voltage having a polarity the same as a polarity of the first data voltage to a first terminal of a boost capacitor of the liquid crystal display by turning on a boost switching element of the liquid crystal display after the first and the second switching elements are turned off, where the liquid crystal display includes: a first gate line; a first data line crossing the first gate line; the first switching element connected with the first gate line and the first data line; the second switching element connected with the first gate line and the first data line; the first liquid crystal capacitor connected with the first switching element; the second liquid crystal capacitor connected with the second switching element; the boost switching element; and the boost capacitor including the first terminal connected with the boost switching element and a second terminal connected with the first liquid crystal capacitor.

In an exemplary embodiment, the liquid crystal display may further include a second gate line which receives a gate-on voltage when a gate-off voltage is applied to the first gate line, where the boost switching element is connected with the second gate line and the first data line.

In an exemplary embodiment, the liquid crystal display may further include an auxiliary capacitor including a third terminal connected with the boost switching element and a fourth terminal which receives a first voltage.

In an exemplary embodiment, the first terminal and the third terminal may be the same terminal, and the second terminal may overlap the fourth terminal.

In an exemplary embodiment, the first terminal may be connected to the third terminal, and the second terminal the fourth terminal may be disposed in a same layer.

In an exemplary embodiment, the first gate line may be disposed in the same layer in which the second terminal and the fourth terminal are disposed.

In an exemplary embodiment, the boost switching element may be connected with a third liquid crystal capacitor.

In an exemplary embodiment, the liquid crystal display may further include a second gate line which receives a gate-on voltage when the gate-off voltage is applied to the first gate line; and a second data line adjacent to the first data line, where the boost switching element may be connected with the second gate line and the second data line.

In an exemplary embodiment, the boost switching element may be connected with a third liquid crystal capacitor.

According to the exemplary embodiments of the invention, luminance of the first and the second subpixels of the liquid crystal display are different, thereby improving visibility without decreasing an aperture ratio of the liquid crystal display. Further, side visibility is substantially improved by increasing the charged voltage of the first subpixel, thereby further improving transmittance and luminance of the liquid crystal display.

BRIEF DESCRIPTION OF THE DRAWINGS

The above and other aspects and features of the invention will become more apparent by describing in further detail exemplary embodiments thereof with reference to the accompanying drawings, in which.

DETAILED DESCRIPTION OF THE INVENTION

Figure 1:
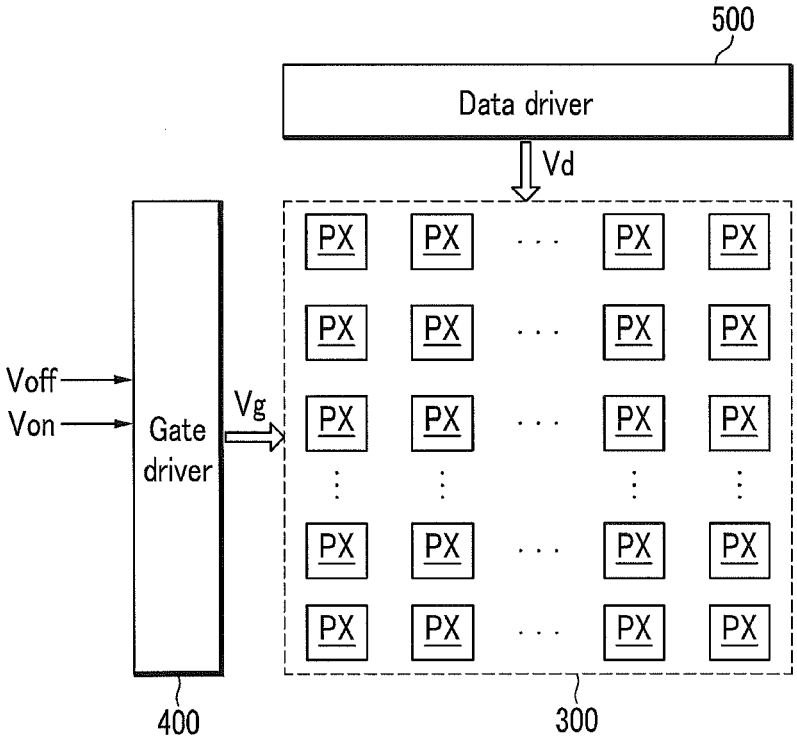
FIG. 1 is a block diagram illustrating an exemplary embodiment of a liquid crystal display according to the invention.

The foregoing is illustrative of the invention and is not to be construed as limiting thereof. Although a few exemplary embodiments of the invention have been described, those skilled in the art will readily appreciate that many modifications are possible in the exemplary embodiments without materially departing from the novel teachings and advantages of the invention. Accordingly, all such modifications are intended to be included within the scope of the invention as defined in the claims.

It will be understood that when an element or layer is referred to as being "on" or "connected to" another element or layer, the element or layer can be directly on or connected to another element or layer or intervening elements or layers. In contrast, when an element is referred to as being "directly on" or "directly connected to" another element or layer, there are no intervening elements or layers present. As used herein, "connected" includes physically and/or electrically connected. Like numbers refer to like elements throughout. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the invention.

Spatially relative terms, such as "lower," "under," "above," "upper" and the like, may be used herein for ease of description to describe the relationship of one element or feature to another element(s) or feature(s) as illustrated in the figures. It will be understood that the spatially relative terms are intended to encompass different orientations of the device in use or operation, in addition to the orientation depicted in the figures. For example, if the device in the figures is turned over, elements described as "under" relative to other elements or features would then be oriented "above" relative to the other elements or features. Thus, the exemplary term "under" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

All methods described herein can be performed in a suitable order unless otherwise indicated herein or otherwise clearly contradicted by context. The use of any and all examples, or exemplary language (e.g., "such as"), is intended merely to better illustrate the invention and does not pose a limitation on the scope of the invention unless otherwise claimed. No language in the specification should be construed as indicating any non-claimed element as essential to the practice of the invention as used herein.

Hereinafter, exemplary embodiments of the invention will be described in further detail with reference to the accompanying drawings.

An exemplary embodiment of a liquid crystal display according to the invention will now be described with reference to FIGS. 1 and 2.

Figure 2:
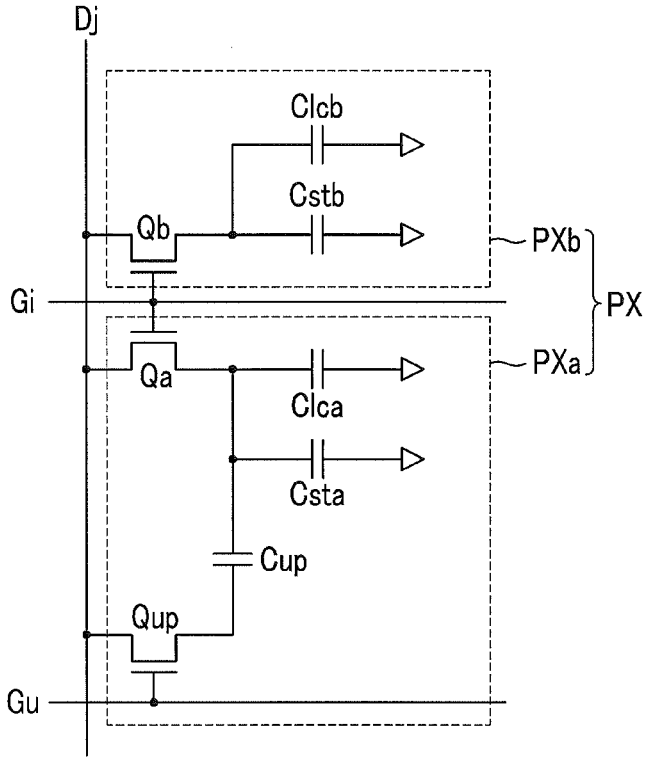
FIG. 2 is an equivalent circuit diagram illustrating a single pixel of an exemplary embodiment of a liquid crystal display according to the invention.

FIG. 1 is a block diagram illustrating an exemplary embodiment of a liquid crystal display according to the invention, and FIG. 2 is an equivalent circuit diagram illustrating a single pixel of an exemplary embodiment of a liquid crystal display according to the invention.

Referring to FIG. 1, an exemplary embodiment of a liquid crystal display includes a liquid crystal panel assembly 300, a gate driver 400 and a data driver 500.

Referring to FIGS. 1 and 2, the liquid crystal panel assembly 300 includes a plurality of signal lines Gi, Gu and Dj and a plurality of pixels PX which are connected thereto and arranged substantially in a matrix form when viewed from the equivalent circuit diagram.

The signal lines Gi, Gu and Dj include a plurality of gate lines Gi (i=1, . . . , n) that transmits a gate signal (also, also referred to as a "scanning signal"), a plurality of boost gate lines Gu and a plurality of data lines Dj (j=1, . . . , m) that transmits a data voltage Vd.

The gate lines Gi (i=1, . . . , n) and the boost gate lines Gu extend substantially in a row direction, and the data lines Dj (j=1, . . . , m) extend substantially in a column direction. In an exemplary embodiment, the gate lines Gi (i=1, . . . , n) may be substantially parallel to each other, and the data lines Dj (j=1, . . . , m) may be substantially parallel to each other. The boost gate lines Gu may be connected with next gate lines G(i+x) (x=1, . . . , n−i) at an edge of the liquid crystal panel assembly 300.

Each of the pixels PX includes a first subpixel PXa and a second subpixel PXb. The first subpixel PXa includes a first switching element Qa, a first liquid crystal capacitor Clca, a first storage capacitor Csta, a boost switching element Qup and a boost capacitor Cup, and the second subpixel PXb includes a second switching element Qb, a second liquid crystal capacitor Clcb and a second storage capacitor Cstb.

Each of the first switching element Qa, the second switching element Qb and the boost switching element Qup may be a three-terminal element such as a thin film transistor, for example.

A control terminal of the first switching element Qa is connected with a corresponding gate line, e.g., an i-th gate line Gi, an input terminal is connected with a corresponding data line, e.g., an j-th data line Dj, and an output terminal is connected with the first liquid crystal capacitor Clca, the first storage capacitor Csta and the boost capacitor Cup.

A control terminal of the second switching element Qb is connected with the i-th gate line Gi, an input terminal is connected with the j-th data line Dj, and an output terminal is connected with the second liquid crystal capacitor Clcb and the second storage capacitor Cstb.

A control terminal of the boost switching element Qup is connected with a corresponding boost gate line Gu, an input terminal is connected with the j-th data line Dj, and an output terminal is connected with the boost capacitor Cup.

The first liquid crystal capacitor Clca includes a first subpixel electrode (not shown) and an opposing electrode (not shown) as two terminals thereof, and the second liquid crystal capacitor Clcb also includes a second subpixel electrode (not shown) and an opposing electrode (not shown) as two terminals thereof, in which a liquid crystal layer (not shown) between the two electrodes acts as a dielectric material. In an exemplary embodiment, the first storage capacitor Csta and the second storage capacitor Cstb support the first liquid crystal capacitor Clca and the second liquid crystal capacitor Clcb, respectively. In an alternative exemplary embodiment, the first storage capacitor Csta and the second storage capacitor Cstb may be omitted.

The boost capacitor Cup is constituted by overlapping the output terminal of the boost switching element Qup and the output terminal of the first switching element Qa or the first subpixel electrode, which is a terminal of the first liquid crystal capacitor Clca, with an insulator interposed therebetween.

In an exemplary embodiment, each of the pixels PX displays one of primary colors (spatial division) or alternately displays primary colors over time (temporal division) to realize a desired color by a spatial summation and temporal summation of the primary colors. The primary colors may be three primary colors, e.g., red, green and blue. In an exemplary embodiment, each of the pixels PX may include a color filter (not shown) corresponding to one of the primary colors.

At least one polarizer (not shown) may be provided in the liquid crystal panel assembly 300.

Referring back to FIGS. 1 and 2, the data driver 500 is connected with the data lines Dj (j=1, . . . , m) of the liquid crystal panel assembly 300 and applies a data voltage Vd to the data lines Dj (j=1, . . . , m).

The gate driver 400 is connected with the gate lines Gi (i=1, . . . , n) of the liquid crystal panel assembly 300 and applies a gate signal Vg, which may include a gate-on voltage Von, which turns on the first and second switching elements Qa and Qb, and a gate-off voltage Voff, which turns off the first and second switching elements Qa and Qb, to the gate lines Gi (i=1, . . . , n) and the boost gate lines Gu.

Hereinafter, an operation of the liquid crystal display will be described with reference to FIG. 14 in addition to FIGS. 1 and 2 described above.

Figure 14:
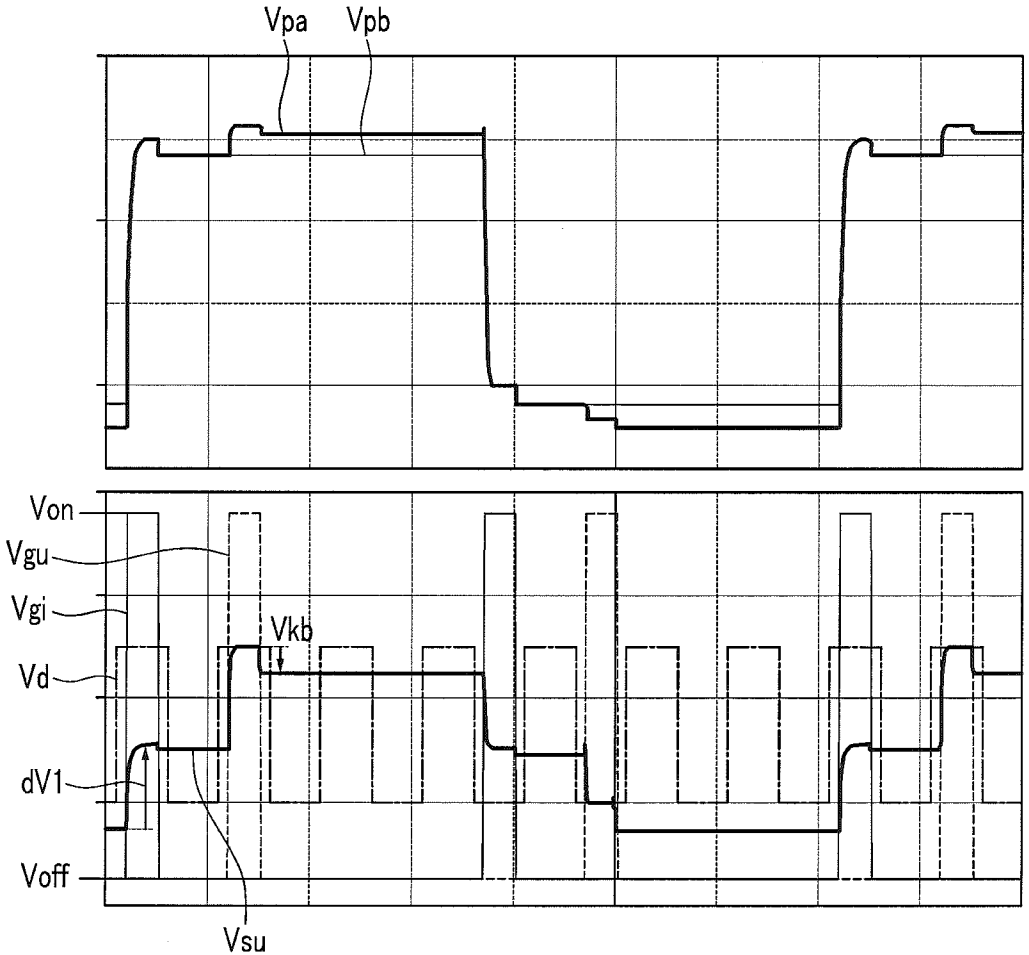
FIG. 14 is a signal timing diagram of a gate signal, a data voltage, a voltage of an output terminal of a boost switching element, and a voltage of a subpixel electrode in an exemplary embodiment of a liquid crystal display according to the invention.

FIG. 14 is a signal timing diagram of a gate signal Vgi of a gate line Gi, a gate signal Vgu of a boost gate lines Gu, the data voltage Vd, a voltage Vsu of an output terminal of a boost switching element Qup, and voltages Vpa and Vpb of first and second subpixel electrodes in an exemplary embodiment of a liquid crystal display according to the invention.

The data driver 500 receives digital image signals from outside and selects gray voltage corresponding to each of the digital image signals to convert the digital image signals to the data voltage Vd, which may be an analog voltage, and then apply the data voltage Vd to a corresponding data line, e.g., the j-th data line Dj.

The gate driver 400 applies the gate-on voltage Von to the gate lines Gi (i=1, . . . , n) in sequence.

First, when the gate-on voltage Von is applied to the i-th gate line Gi, the first and second switching elements Qa and Qb connected thereto are turned on, and the data voltage Vd applied to the j-th data line Dj is commonly applied to the first and second subpixel electrodes of the first and second liquid crystal capacitors Clca and Clcb through the turned-on first and second switching elements Qa and Qb, respectively. In such an embodiment, the gate-off voltage Voff is applied to the boost gate line Gu.

Next, when the gate-on voltage Von is applied to the boost gate line Gu while the gate-off voltage Voff is applied to the i-th gate line Gi, the first and second switching elements Qa and Qb connected to the i-th gate line Gi are turned off, and the boost switching element Qup is turned on. In such an embodiment, the voltage Vpa of the first subpixel electrode of the first liquid crystal capacitor Clca, which is connected to the boost switching element Qup through the boost capacitor Cup, is changed such that the charged voltage of the first liquid crystal capacitor Clca increases. In such an embodiment, when the gate-on voltage Von is applied to the boost gate line 121*u* and the next gate line, e.g., the (i+x)-th gate line G(i+x), connected thereto, a data voltage Vd having a polarity identical to a polarity of the data voltage Vd applied to the first and second subpixel electrodes of the first and second liquid crystal capacitors Clca and Clcb are applied to the j-th data line Dj.

As shown in FIG. 14, when the data voltage Vd has positive polarity with respect to a common voltage (e.g., about 7 V in FIG. 14), the voltage Vpa of the first subpixel electrode increases. In an exemplary embodiment, however, when the data voltage Vd has negative polarity, the voltage Vpa of the first subpixel electrode decreases, and the charged voltage of the first liquid crystal capacitor Clca is thereby increased.

Accordingly, after the boost switching element Qup is turned on, the charged voltage of the first liquid crystal capacitor Clca is greater than the charged voltage of the second liquid crystal capacitor Clcb, and luminances of the first subpixel PXa and the second subpixel PXb are thereby different. In an exemplary embodiment, as described above, the voltages of the two liquid crystal capacitors Clca and Clcb may be adjusted such that the image viewed from the side is substantially close to the image viewed from the front, thereby improving the side visibility of the liquid crystal display. In such an embodiment, since the charged voltage of the first liquid crystal capacitor Clca is boosted without decreasing the charged voltage of the second liquid crystal capacitor Clcb to improve the side visibility, the transmittance and luminance of the liquid crystal display may be substantially increased.

As such, the gate-on voltage Von is sequentially applied to all the gate lines Gi (i=1, . . . , n) and data voltages Vd are applied to all the pixels PX, thereby displaying an image of one frame. The next frame starts after the one frame ends, and a state of an inversion signal applied to the data driver 500 is controlled such that the polarity of the data voltage Vd applied during the next frame is opposite to the polarity of the data voltage applied the one frame ("frame inversion").

In an exemplary embodiment of the invention, the first and second liquid crystal capacitors Clca and Clcb may be precharged by performing an overlap driving in which the gate-on voltage Von is applied to a next gate line, e.g., the (i+1)-th gate line G(i+1), before the gate-off voltage Voff is applied to a gate line, e.g., the i-th gate line Gi. However, when the boost gate line Gu is connected with the next gate line, e.g., the (i+1)-the gate line G(i+1) of the i-th gate line Gi connected with the corresponding pixel PX, the gate-on voltage Von may not be simultaneously applied to the two gate lines Gi and G(i+1).

Hereinafter, an exemplary embodiment of the liquid crystal display shown in FIGS. 1 and 2 will be described in greater detail with reference to FIGS. 3 and 4.

Figure 3:
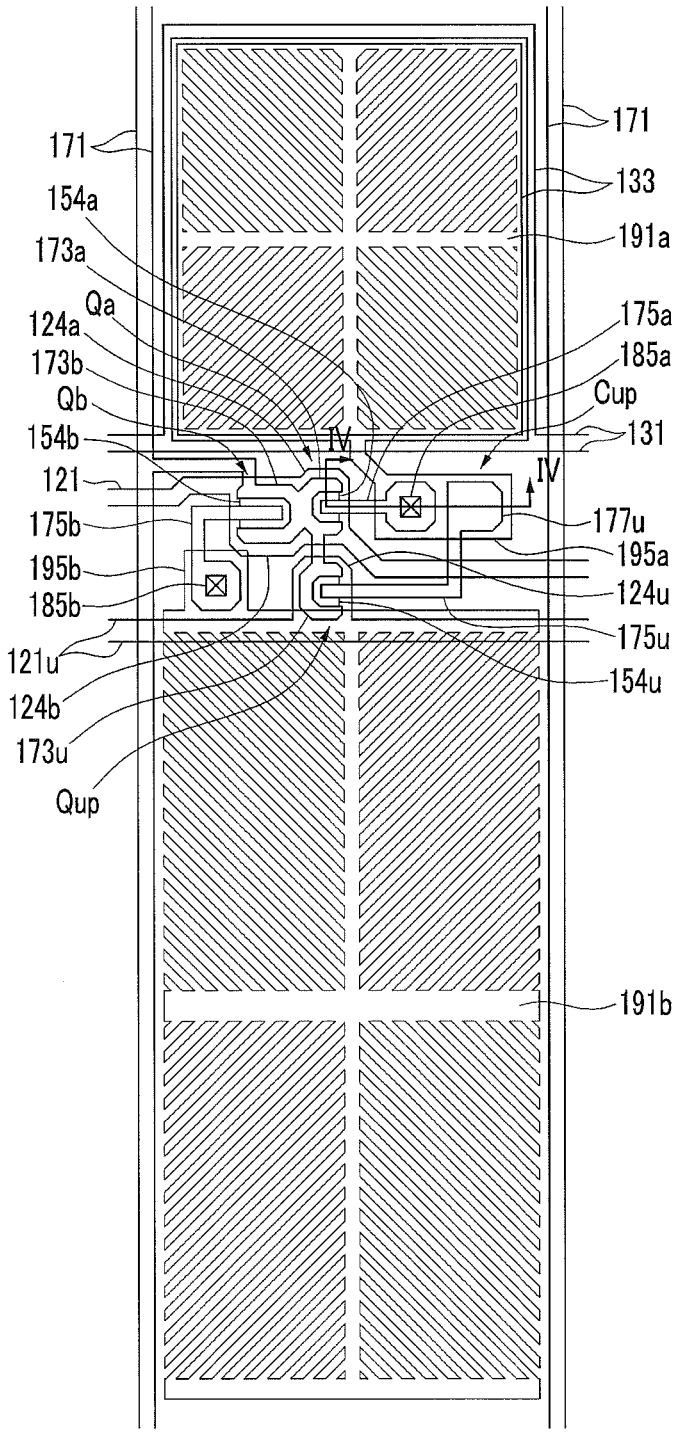
FIG. 3 is a top plan view of a single pixel of an exemplary embodiment of a liquid crystal display according to the invention.
Figure 4:
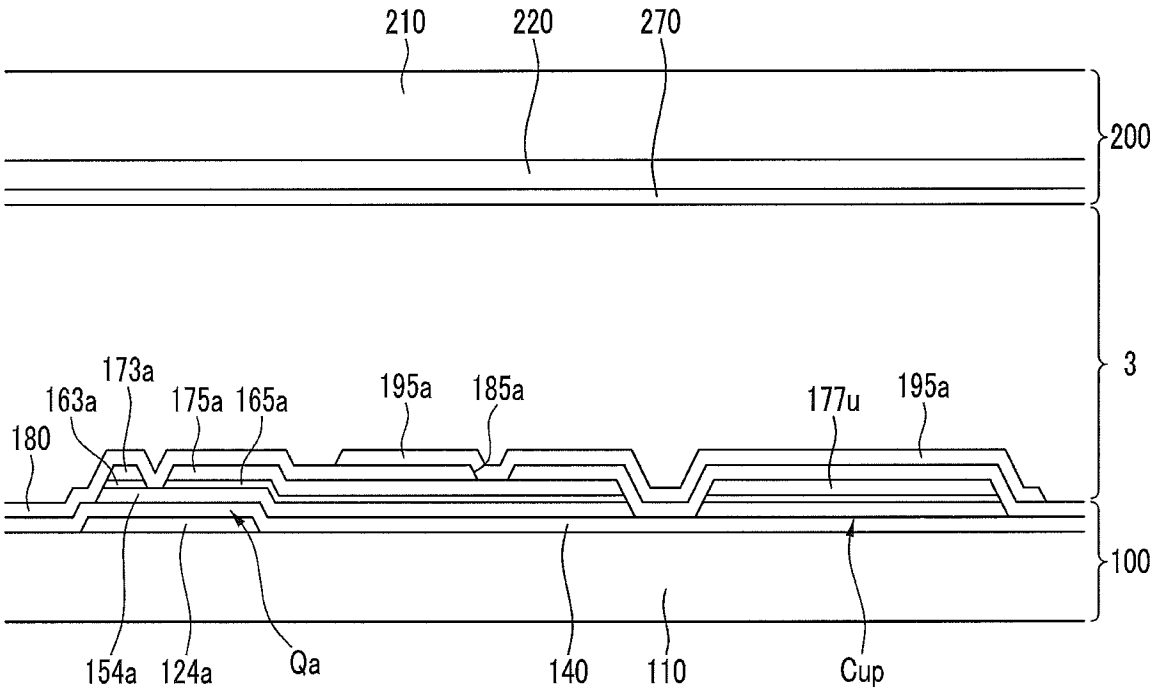
FIG. 4 is a cross-sectional view taken along line IV-IV of the liquid crystal display of FIG. 3.

FIG. 3 is a top plan view of a single pixel of an exemplary embodiment of a liquid crystal display according to the invention, and FIG. 4 is a cross-sectional view taken along line IV-IV of the liquid crystal display of FIG. 3.

An exemplary embodiment of the liquid crystal display includes a lower panel 100, an upper panel 200 disposed opposite to the lower panel 100 and a liquid crystal layer 3 interposed between the lower and upper panels 100 and 200.

First, the upper panel 200 includes an insulating substrate 210, a light blocking member 220 disposed on the insulating substrate 210, a color filter (not shown) disposed on the Insulating substrate 210 and an opposing electrode 270 disposed on the light blocking member 220. The opposing electrode 270 may be provided as a whole plate on the Insulating substrate 210. An upper alignment layer (not shown) may be provided on the opposing electrode 270.

In an alternate exemplary embodiment, unlike the configuration shown in FIG. 4, at least one of the light blocking member 220 and the color filter may be disposed on the lower panel 100.

The liquid crystal layer 3 has a negative dielectric anisotropy, and the liquid crystal molecules of the liquid crystal layer 3 are aligned such that longitudinal axes thereof are substantially perpendicular to the surfaces of the lower and upper panels 100 and 200 when an electric field is not generated in the liquid crystal layer 3.

Next, the lower panel 100 will be described.

A plurality of gate conductors including a plurality of gate lines 121, a plurality of boost gate lines 121*u*, and a plurality of common voltage lines 131 are disposed on an insulating substrate 110.

The gate line 121 extends substantially in a horizontal direction and transmits a gate signal. The gate line 121 includes a plurality of pairs of first gate electrodes 124*a* and second gate electrodes 124*b*. The first gate electrodes 124*a* and the second gate electrodes 124*b* may be connected to each other.

The boost gate line 121*u* extends substantially in a horizontal direction and transmits a gate signal. The boost gate line 121*u* includes a plurality of third gate electrodes 124*u*. The boost gate line 121*u* may be connected with a next gate line 121 at the edge region of the the lower panel 100.

The common voltage line 131 extends substantially in a horizontal direction and transmits a constant voltage such as the common voltage. The common voltage line 131 includes a ring portion 133 extending upwardly and having a ring shape.

A gate insulating layer 140 is disposed on the gate conductor.

A plurality of semiconductor stripes (not shown) that may include amorphous silicon or crystalline silicon is disposed on the gate insulating layer 140. The semiconductor stripes extends substantially in a vertical direction and include first and second semiconductors 154*a* and 154*b*, which extend toward the first and second gate electrodes 124*a* and 124*b* and are connected to each other, and a third semiconductor 154*u* connected with the first semiconductor 154*a*.

A pair of ohmic contacts 163*a* and 165*a* is disposed on the first semiconductor 154*a*, and a pair of ohmic contacts (not shown) is disposed on each of the second semiconductor 154*b* and the third semiconductor 154*u*. The ohmic contacts 163*a* and 165*a* may include a material such as n+ hydrogenated amorphous silicon doped with n-type impurities such as phosphorus with high concentration or silicide, for example.

A data conductor, including a plurality of data lines 171 and a plurality of first drain electrodes 175, a plurality of second drain electrodes 175*b*, and a plurality of third drain electrodes 175*u*, is disposed on the ohmic contacts 163*a* and 165*a* and the gate insulating layer 140.

The data lines 171 transmit data signals, and may extend substantially in a vertical direction crossing the gate lines 121, the boost gate lines 121*u* and the common voltage lines 131. Each of the data lines 171 includes a first source electrode 173*a* and a second source electrode 173*b* extending toward the first gate electrode 124*a* and the second gate electrode 124*b*, respectively, and a third source electrode 173*u* connected with the first source electrode 173*a*. The first and second source electrodes 173*a* and 173*b* may be connected to each other.

Each of the first drain electrodes 175*a*, the second drain electrodes 175*b* and the third drain electrodes 175*u* includes a bar-shaped end portion and a wide end portion having a relatively large area. The first end portions of the first drain electrode 175*a*, the second drain electrodes 175*b* and the third drain electrodes 175*u* are partially surrounded by the first source electrode 173*a*, the second source electrode 173*b* and the third source electrode 173*u*, respectively. The third drain electrode 175*u* includes a wide end portion having a large area which is opposite to the bar-shaped end portion.

The first and second gate electrodes 124*a* and 124*b*, the first and second source electrodes 173*a* and 173*b*, and the first and second drain electrodes 175*a* and 175*b* form first and second thin film transistors ("TFT"s) Qa and Qb together with the first and second semiconductors 154*a* and 154*b*. The third gate electrode 124*u*, the third source electrode 173*u* and the third drain electrode 175*u* together with the third semiconductor 154*u* form a boost thin film transistor Qup. A channel of each thin film transistor is formed in each of the semiconductors 154*a*, 154*b* and 154*u* disposed between the source electrodes 173*a*, 173*b* and 173*u* and the drain electrodes 175*a*, 175*b* and 175*u*, respectively.

The semiconductor stripe including the first, second and third semiconductors 154*a*, 154*b* and 154*u* may have substantially the same planar shape as a planar shape of the data conductor and the ohmic contacts 163*a* and 165*a* disposed therebelow, except for the channel region between the first, second and third source electrodes 173*a*, 173*b* and 173*u* and the first, second and third drain electrodes 175*a*, 175*b* and 175*u*, respectively.

A passivation layer 180, which may include an inorganic insulator, such as silicon nitride or silicon oxide, or an organic insulator, is disposed on and overlapping the data conductor and the exposed first second, and third semiconductors 154*a*, 154*b*, and 154*u*. A first contact hole 185*a* exposing a wide end portion of the first drain electrode 175*a* and a second contact hole 185*b* exposing a wide end portion of the second drain electrode 175*b* are formed in the passivation layer 180.

A pixel electrode including a first subpixel electrode 191*a* and a second subpixel electrode 191*b* is formed on the passivation layer 180. The first subpixel electrode 191*a* and a second subpixel electrode 191*b* may include a transparent conductive material, such as indium tin oxide ("ITO") and indium zinc oxide ("IZO"), for example, or a reflective metal, such as aluminum, silver, chromium or a alloy thereof. The first subpixel electrode 191*a* and the second subpixel electrode 191*b* are disposed in a column direction and separated from each other with the gate line 121, the boost gate line 121*u* and the common voltage line 131 interposed therebetween. A height of the second subpixel electrode 191*b* may be greater than a height of the first subpixel electrode 191*a*. In one exemplary embodiment, for example, the height of the second subpixel electrode 191*b* may be about one to three times greater than the height of the first subpixel electrode 191*a*.

An overall shape of the contour of the first subpixel electrode 191*a* and the second subpixel electrode may be a quadrangle.

The first subpixel electrode 191*a* includes a cross-shaped stem including a horizontal stem and a vertical stem, an outer portion forming the contour of the first subpixel electrode 191*a*, and a protrusion portion 195*a* protruding from the lower portion of the outer portion. A portion of the protrusion portion 195*a* is connected with the first drain electrode 175*a* through the first contact hole 185*a* to receive the data voltage. The ring portion 133 of the common voltage line 131 surrounds of the first subpixel electrode 191*a*, and light leakage is thereby effectively prevented.

The second subpixel electrode 191*b* includes a cross-shaped stem including a horizontal stem and a vertical stem, an upper horizontal portion, a lower horizontal portion, and a protrusion portion 195*b* protruding from the upper horizontal portion and connected with the second drain electrode 175*b* through the second contact hole 185*b*. The second subpixel electrode 191*b* receives the data voltage from the second drain electrode 175*b*.

Each of the first subpixel electrode 191*a* and the second subpixel electrode 191*b* is divided into four subregions by the cross-shaped stem, and each of the subregions includes a plurality of minute branches obliquely extending from the cross-shaped stem. In one exemplary embodiment, an angle formed by the minute branches with the gate line 121 may be about 45 degrees or 135 degrees, for example.

Sides of the minute branches of the first and second subpixel electrodes 191*a* and 191*b* distort the electric field in the liquid crystal layer 3 to form a horizontal component substantially perpendicular to the sides of the minute branches, and an inclination direction of the liquid crystal molecules is determined in a direction determined by the horizontal components of the electric field. Accordingly, the liquid crystal molecules initially tend to incline in a direction perpendicular to the sides of the minute branches. However, since directions of the horizontal components of the electric field are opposite to each other, and the width of the minute branches or the distance between the minute branches is less than the cell gap of the liquid crystal layer 3, the liquid crystal molecules which initially tend to incline in the opposite direction to each other are consequently inclined in a direction substantially parallel to the longitudinal directions of the minute branches.

In an exemplary embodiment of the invention, each of the first and second subpixel electrodes 191*a* and 191*b* has four subregions, in which the longitudinal directions of the minute branches are different from each other, and the inclination directions of the liquid crystal molecules in the liquid crystal layer 3 are thereby four. In an exemplary embodiment, when the liquid crystal molecules are inclined to various directions in each of the first subpixel PXa and the second subpixel PXb, and the reference viewing angle of the liquid crystal display is thereby increased.

The first subpixel electrode 191*a* and the opposing electrode 270 form a first liquid crystal capacitor Clca together with the liquid crystal layer 3 interposed therebetween, and the second subpixel electrode 191*b* and the opposing electrode 270 form a second liquid crystal capacitor Clcb together with the liquid crystal layer 3 interposed therebetween. In an exemplary embodiment, the protrusion portion 195*a* of the first subpixel electrode 191*a* and the extension portion 177*u* of the third drain electrode 175*u* form a boost capacitor Cup by overlapping each other with the passivation layer 180 interposed therebetween. Detailed description of the first and second liquid crystal capacitors Clca and Clcb and the boost capacitor Cup, will be omitted as the components were described above referring to FIGS. 1 and 2.

A lower alignment layer (not shown) may be disposed on the pixel electrode 191. The upper alignment layer and the lower alignment layer may be vertical alignment layers.

In an exemplary embodiment of the liquid crystal display according to the invention, the charged voltages of the first and the second liquid crystal capacitors Clca and Clcb are different, thereby substantially improving side visibility without decreasing the aperture ratio.

Hereinafter, an alternative exemplary embodiment of a liquid crystal display according to the invention will be described with reference to FIG. 5 in addition to FIGS. 1 and 14 described above.

Figure 5:
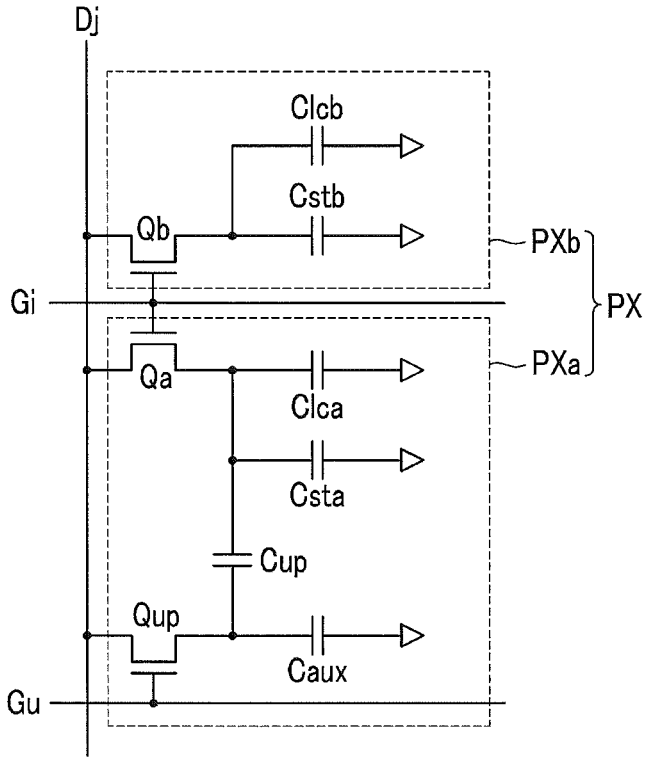
FIG. 5 is an equivalent circuit diagram illustrating a single pixel of an alternative exemplary embodiment of a liquid crystal display according to the invention.

FIG. 5 is an equivalent circuit diagram of a single pixel of an alternative exemplary embodiment of a liquid crystal display according to the invention.

The exemplary embodiment shown in FIG. 5 is substantially the same as the exemplary embodiment shown in FIG. 2, except that the first subpixel PXa in FIG. 5 further includes an auxiliary capacitor Caux including a first terminal connected to the output terminal of the boost switching element Qup and to the boost capacitor Cup, and a second terminal which receives a constant voltage such as the common voltage. The same or like elements in FIG. 5 have been labeled with the same reference characters as used above to describe the exemplary embodiments of the liquid crystal display in FIG. 2, and any repetitive detailed description thereof will hereinafter be omitted or simplified. The capacitance of the auxiliary capacitor Caux may be substantially equal to or substantially similar to the capacitance of the boost capacitor Cup.

Referring again to FIG. 14, the voltage Vsu of the output terminal of the boost switching element Qup, which is connected to the first switching element Qa via the boost capacitor Cup, is changed when the gate-on voltage Von is applied to the gate line Gi. In an exemplary embodiment, in which the auxilliary capacitor Caux is included, a change value dV1 of the voltage Vsu of the output terminal of the boost switching element Qup may be further decreased, and thus, a change amount of the voltage Vsu of the output terminal of the boost switching element Qup may be further increased when the gate-on voltage Von is applied to the boost gate lines Gu.

Therefore, when the gate-on voltage Von is applied to the boost gate lines Gu, a change amount of the voltage Vpa of the first subpixel electrode may be further increased, and the luminance of the first subpixel PXa may be further increased.

In such an embodiment, when the gate signal Vgu of the boost gate lines Gu is changed from the gate-on voltage Von to the gate-off voltage Voff, the voltage Vsu of the output terminal of the boost switching element Qup drops by a kickback voltage Vkb. The value of the kickback voltage Vkb may be determined by the following Equation 1.

$$Vkb = (Von - Voff) * Cgs/(Cgs + Cup + Caux) \quad \text{[Equation 1]}$$

In Equation 1, Cgs denotes the parasite capacitance between the control terminal and the output terminal of the boost switching element, Cup denotes the capacitance of the boost capacitor, and Caux denotes the capacitance of the auxiliary capacitor Caux. According to Equation 1, since the kickback voltage Vkb of the voltage Vsu of the output terminal of the boost switching element Qup may be decreased due to the auxiliary capacitor Caux in such an embodiment, the change amount of the voltage Vpa of the first subpixel electrode according to the change of the output terminal of the boost switching element Qup may be also decreased. Accordingly, when the gate-off voltage Voff is applied to the boost gate lines Gu, the luminance of the first subpixel PXa may be effectively prevented from being decreased.

In such an embodiment, since the capacitances of the auxiliary capacitor Caux as well as the boost capacitor Cup may be adjusted to adjust the voltage ratio of the first subpixel electrode and the second subpixel electrode, it is further advantageous to optimize the side visibility and transmittance of the liquid crystal display.

An exemplary embodiment of the liquid crystal display shown in FIG. 5 will be described in greater detail with reference to FIGS. 6 to 9.

Figure 6:
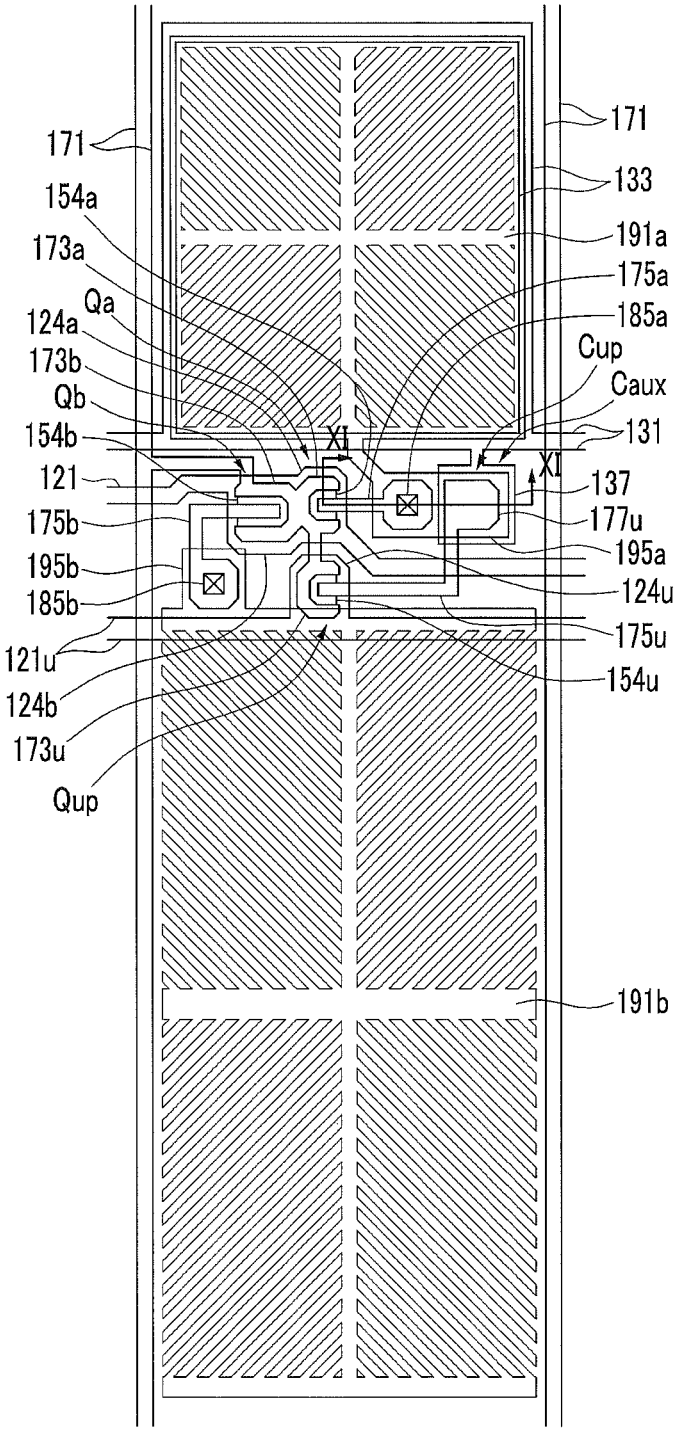
FIG. 6 is a top plan view of a single pixel of an alternative exemplary embodiment of a liquid crystal display according to of the invention.
Figure 7:
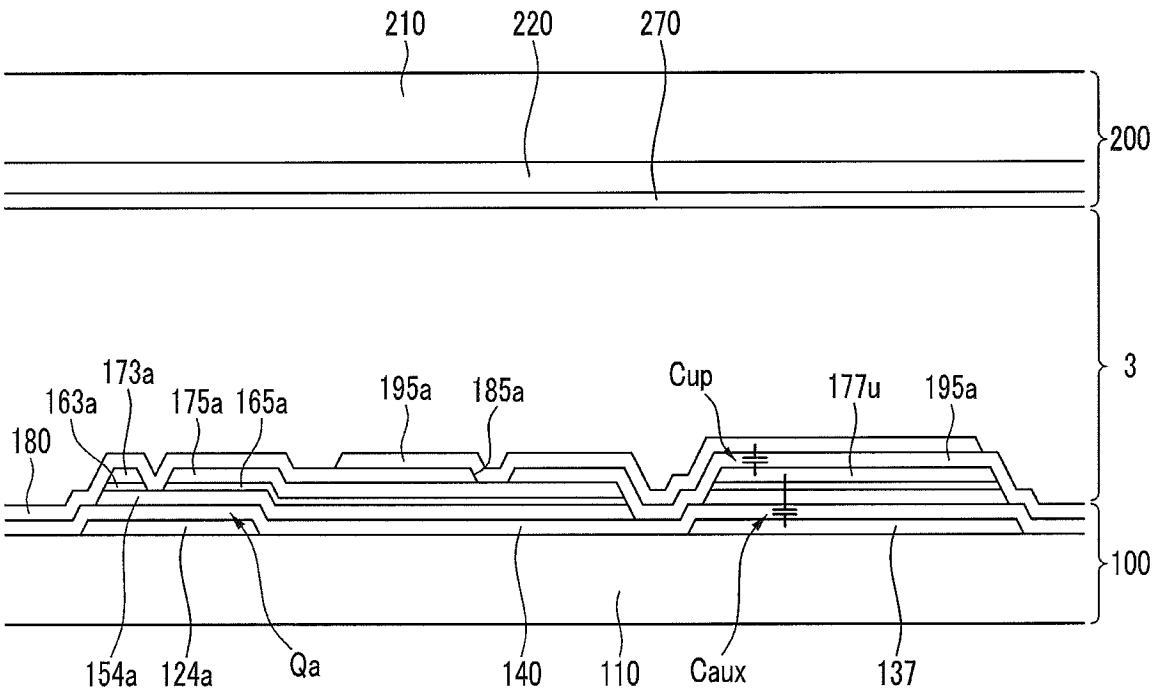
FIG. 7 is a cross-sectional view taken along line XI-XI of the liquid crystal display of FIG. 6.
Figure 8:
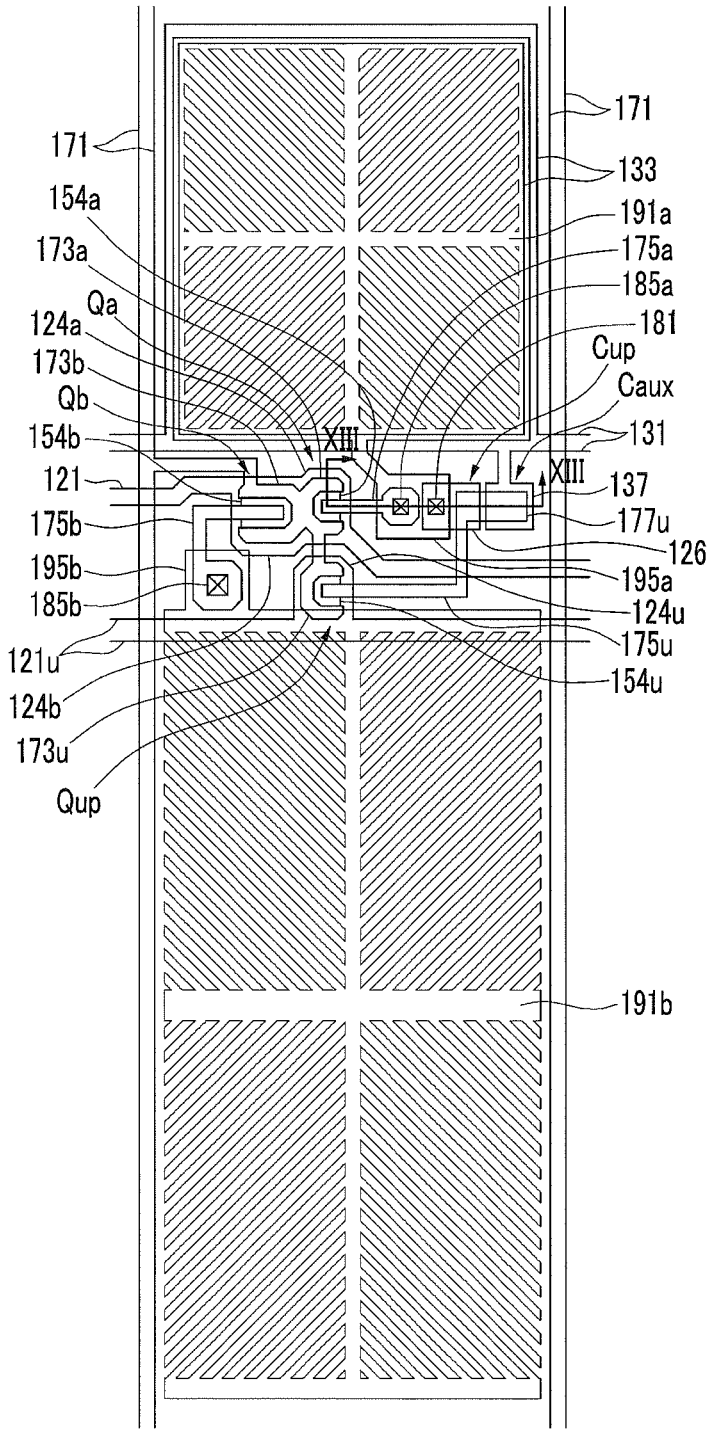
FIG. 8 is a top plan view of a single pixel of another alternative exemplary embodiment of a liquid crystal display according to the invention.
Figure 9:
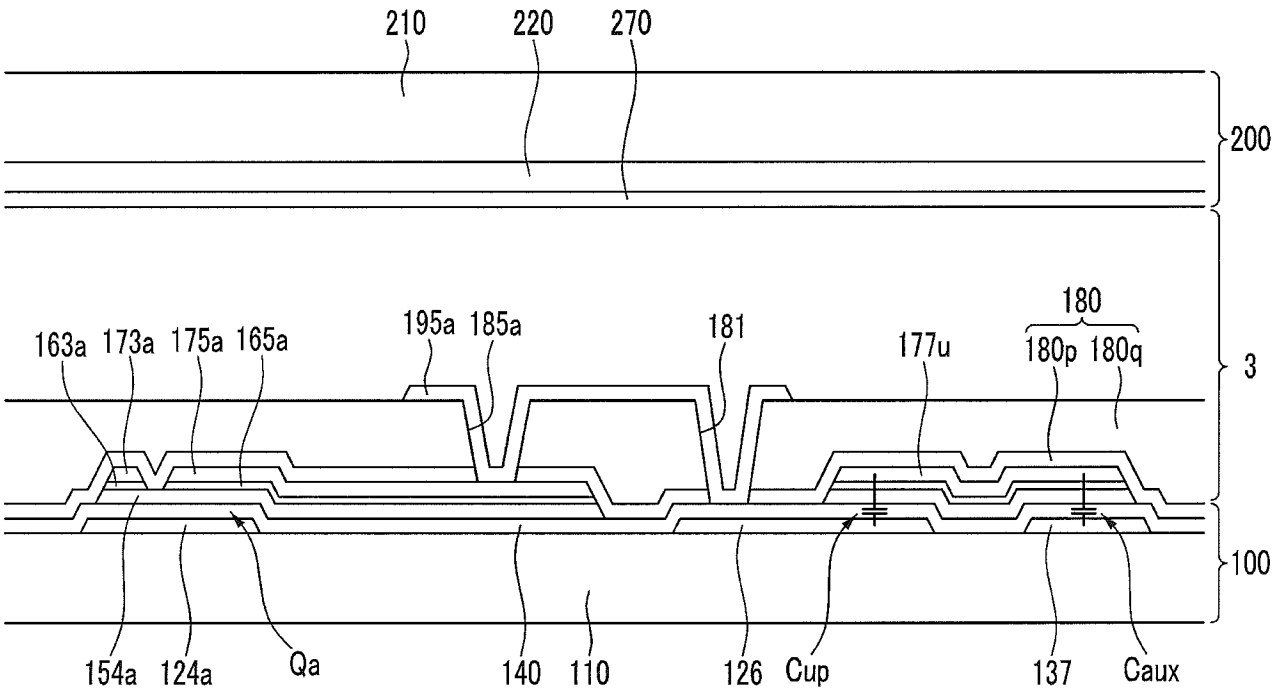
FIG. 9 is a cross-sectional view taken along line XIII-XIII of the liquid crystal display of FIG. 8.

FIG. 6 is a top plan view of a single pixel of an alternative exemplary embodiment of a liquid crystal display according to the invention, FIG. 7 is a cross-sectional view taken along line XI-XI of the liquid crystal display of FIG. 6, FIG. 8 is a top plan view of a single pixel of another alternative exemplary embodiment of a liquid crystal display according to the invention, and FIG. 9 is a cross-sectional view taken along line XIII-XIII of the liquid crystal display of FIG. 8. The liquid crystal displays in FIGS. 6 to 9 are substantially the same as the liquid crystal display of FIGS. 3 and 4 described above. The same or like elements shown in FIGS. 6 to 9 have been labeled with the same reference characters as used above to describe the exemplary embodiments of the display device shown in FIGS. 3 and 4, and any repetitive detailed description thereof will hereinafter be omitted or simplified.

In an exemplary embodiment shown in FIGS. 6 and 7, the common voltage line 131 further includes an extension portion 137 which protrudes downward, and the auxiliary capacitor Caux is thereby formed. The extension portion 137 form the auxiliary capacitor Caux by overlapping the extension portion 177*u* of a third drain electrode 175*u* of the boost thin film transistor Qup with the gate insulating layer 140 interposed therebetween. In an exemplary embodiment, the passivation layer 180 may include an inorganic insulator when the boost capacitor Cup is included.

In an alternative exemplary embodiment shown in FIGS. 8 and 9, the liquid crystal display further includes a connection electrode 126 which may be disposed on the insulating substrate 110. The connection electrode 126 may be provided together with gate conductors 121, 121*u* and 131. In an exemplary embodiment, the passivation layer 180 may have a dual-layer structure including a lower inorganic layer 180*p* and an upper inorganic layer 180*q* to prevent damages on the exposed portion of the semiconductors 154*a*, 154*b* and 154*u* while maintaining an insulating property of an organic layer. The passivation layer 180 and the gate insulating layer 140 have contact holes 181 exposing a part of the connection electrode 126.

In an exemplary embodiment, the protrusion portion 195*a* of the first subpixel electrode 191*a* is electrically connected with the connection electrode 126 through the contact hole 181 without overlapping the extension portion 177*u* of the third drain electrode 175*u* of the boost thin film transistor Qup, and a portion of the connection electrode 126 forms the boost capacitor Cup by overlapping the extension portion 177*u* of the third drain electrode 175*u* of the boost thin film transistor Qup with the gate insulating layer 140 interposed therebetween.

In such an embodiment, the auxiliary capacitor Caux is formed by disposing the extension portion 137 of the common voltage line 131 to overlap the extension portion 177*u* of the third drain electrode 175*u* of the boost thin film transistor Qup with the gate insulting layer 140 interposed therebetween, similarly to the exemplary embodiment shown in FIGS. 6 and 7.

The liquid crystal display shown in FIGS. 6 to 9 may has similar features and aspects of the liquid crystal display shown in FIGS. 3 and 4.

Hereinafter, another alternative exemplary embodiment of a liquid crystal display according to the invention will be described referring to FIG. 10. The same reference numerals refer to the same elements as used above to describe the exemplary embodiments of the liquid crystal display in FIGS. 2 and 5, and any repetitive detailed description thereof will hereinafter be omitted or simplified.

Figure 10:
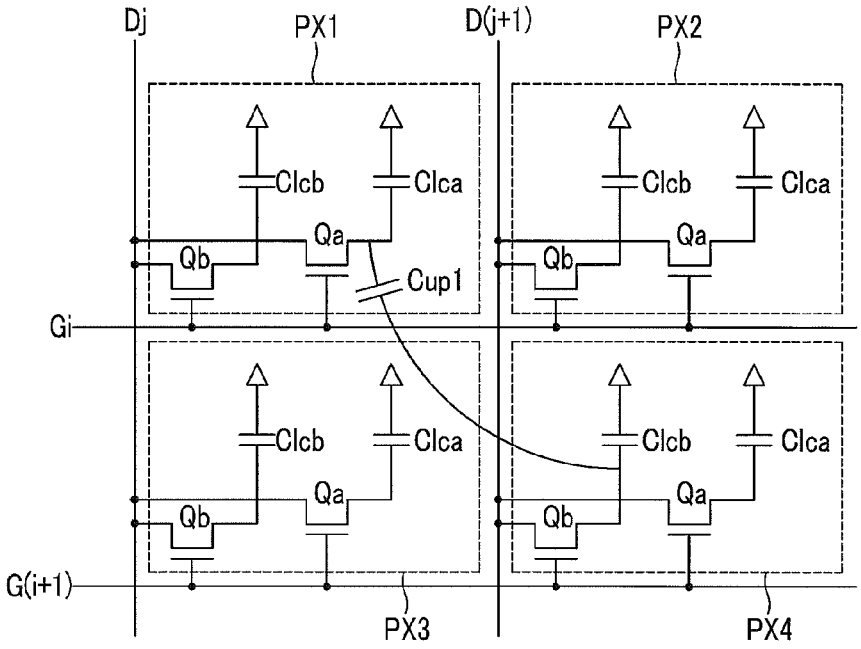
FIG. 10 is an equivalent circuit diagram illustrating four adjacent pixels of an exemplary embodiment of a liquid crystal display according to the invention.

FIG. 10 is an equivalent circuit diagram of four adjacent pixels of another alternative exemplary embodiment of a liquid crystal display according to the invention.

Referring to FIG. 10, an exemplary embodiment of the liquid crystal display includes a plurality of gate lines, e.g., an i-th gate line Gi and an (i+1)-th gate line G(i+1) and a plurality of data lines, e.g., a j-th data line Dj and a (j+1)-th data line D(j+1), and a plurality of pixels, e.g., a first pixel PX1, a second pixel PX2, a third pixel PX3 and a fourth pixel PX4, that are connected to the gate lines and the data lines and arranged substantially in a matrix form.

Two pixels positioned in an upper row, e.g., the first pixel PX1 and the second pixel PX2, are connected to a corresponding gate line, e.g., the i-th gate line Gi, and the two pixels in the lower row, e.g., the third pixel PX3 and the fourth pixel PX4, are connected to a next gate line, e.g., the (i+1)-th gate line G(i+1).

Each of the pixels PX1, PX2, PX3 and PX4 includes a first switching element Qa, a first liquid crystal capacitor Clca, a second switching element Qb, a second liquid crystal capacitor Clcb and a boost capacitor Cup1.

The boost capacitor Cup1 includes the output terminal of the first switching element Qa of one pixel, e.g., the first pixel PX1, and the output terminal of the second switching element Qb of another pixel, e.g., the fourth pixel PX4, as two terminals thereof. In such an embodiment, two pixels, e.g., the first pixel PX1 and the fourth pixel PX4, connected through the boost capacitor Cup1 receive the data voltage of the same polarity. In one exemplary embodiment, for example, when the liquid crystal display is driven using 1×1 dot inversion driving method, the two pixels, e.g., the first pixel PX1 and the fourth pixel PX4, to which the boost capacitor Cup1 is connected, may be adjacent to each other in a diagonal direction as shown in FIG. 10.

Hereinafter, an operation of an exemplary embodiment of the liquid crystal display shown in FIG. 10 will be described. First, a gate-on voltage Von is applied to the i-th gate line Gi to turn on the first and second switching elements Qa and Qb of the first pixel PX1 and the second pixel PX2 connected thereto, and the data voltage Vd applied to the j-th data line Dj and the (j+1)-th data line D(j+1) is thereby applied to the first and second liquid crystal capacitors Clca and Clcb through the first and second switching elements Qa and Qb that are turned on.

Then, when a gate-off voltage Voff is applied to the i-th gate line Gi and the gate-on voltage Von is applied to the next gate line, e.g., the (i+1)-th gate line G(i+1), the first and second switching elements Qa and Qb of the pixels, e.g., the third pixel PX3 and the fourth pixel PX4, connected to the next gate line G(i+1) are turned on. In such an embodiment, when the second switching element Qb of the fourth pixel PX4 is turned on, the voltage applied to the first liquid crystal capacitor Clca connected with the output terminal of the first switching element Qa of the first pixel PX1 through the boost capacitor Cup1 also increases or decreases. In an exemplary embodiment, when the data voltage applied to the first pixel PX1 and the fourth pixel PX4 has positive polarity, the voltage applied to the first liquid crystal capacitor Clca of the first pixel PX1 increases. In an exemplary embodiment, however, when the data voltage has negative polarity, the voltage applied to the first liquid crystal capacitor Clca of the first pixel PX1 decreases. Accordingly, when the gate-on voltage Von is applied to the next gate line G(i+1), charged voltage of the first liquid crystal capacitor Clca of the first pixel PX1 increases through the boost capacitor Cup1. Therefore, in the exemplary embodiment, the second switching element Qb of the fourth pixel PX4 performs a function substantially the same as the function of the boost switching element Qup of the exemplary embodiment shown in FIGS. 2 to 9.

Although not shown in FIG. 10, the first switching element Qa of each of the other pixels, e.g., the second pixel PX2, the third pixel PX3 and the fourth pixel PX4, is connected with the second switching element Qb of the pixel adjacent in the diagonal direction at the next row via the boost capacitor Cup1, and thus, when the gate-on voltage Von is applied to the next gate line G(i+1), the charged voltage of the first liquid crystal capacitor Clca increases, and luminance is thereby substantially improved.

In such an embodiment, the charged voltages of the first liquid crystal capacitor Clca and the second liquid crystal capacitor Clcb are different to improve the side visibility, the luminance of the first liquid crystal capacitor Clca is further improved, and the transmittance and luminance of the liquid crystal display are thereby substantially improved.

Hereinafter, an exemplary embodiment of the liquid crystal display shown in FIG. 10 will be described with reference to FIGS. 11 and 12. The same reference numerals refer to the same elements as used above to describe the exemplary embodiments shown in FIGS. 3, 6 and 8, and any repetitive detailed description thereof will hereinafter be omitted or simplified.

Figure 11:
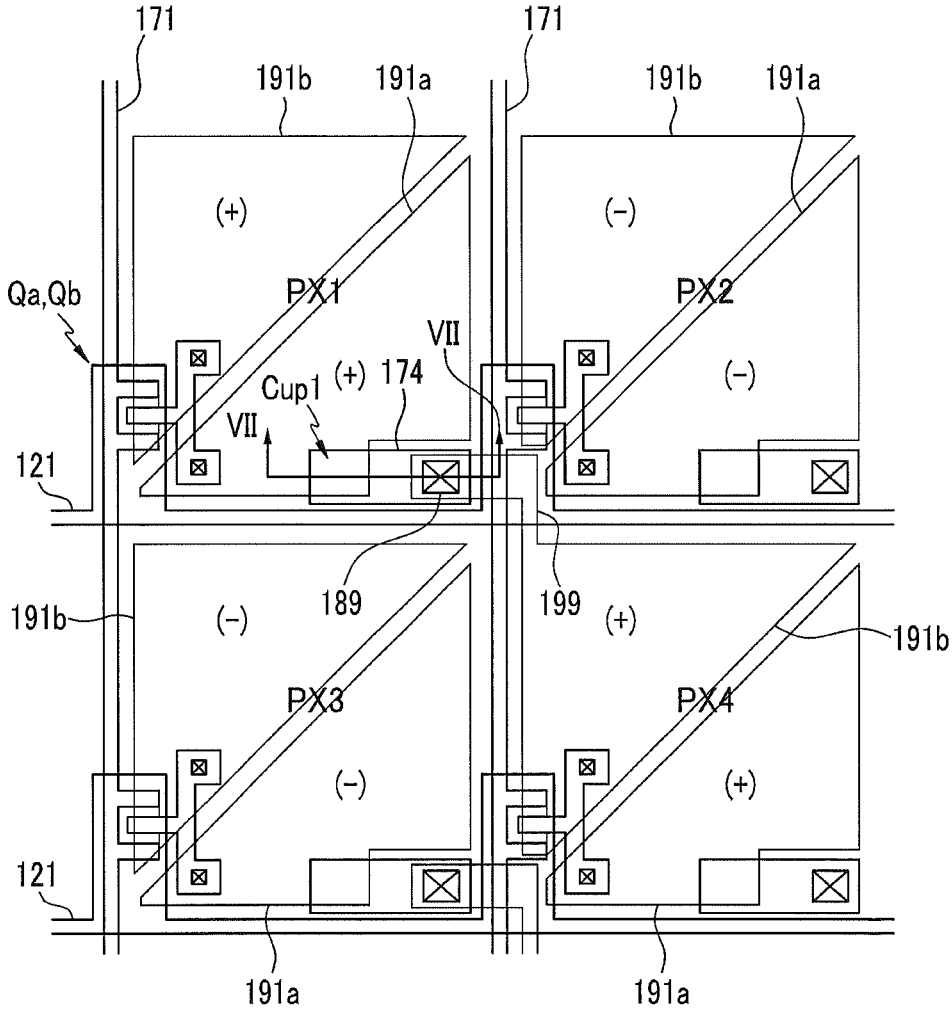
FIG. 11 is a top plan view of four adjacent pixels of an exemplary embodiment of a liquid crystal display according to the invention.
Figure 12:
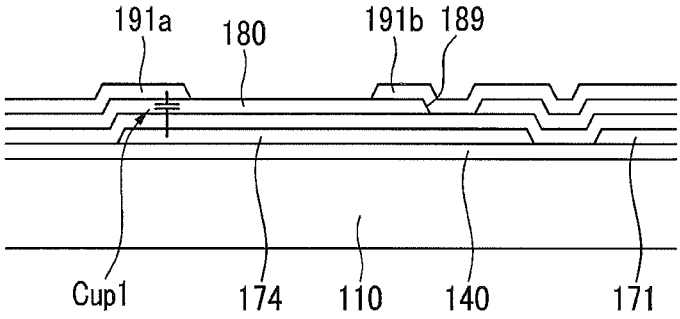
FIG. 12 is a cross-sectional view taken along line VII-VII of the liquid crystal display of FIG. 11.

FIG. 11 is a top plan view of four adjacent pixels of an exemplary embodiment of a liquid crystal display according to the invention, and FIG. 12 is a cross-sectional view taken along line VII-VII of a lower panel of the liquid crystal display of FIG. 11.

Hereinafter, the lower panel of an exemplary embodiment of the liquid crystal display will be described. In an exemplary embodiment, a plurality of gate lines 121, a gate insulating layer 140, a plurality of semiconductors (not shown), a plurality of ohmic contact members (not shown), a plurality of data lines 171 and a plurality of connection electrodes 174 are sequentially disposed on an insulating substrate 110.

A passivation layer 180 having a plurality of contact holes 189 is disposed on the data lines 171, the connection electrodes 174 and an exposed semiconductor part. A plurality of pixel electrodes including a first subpixel electrode 191*a* and a second subpixel electrode 191*b* are disposed on the passivation layer 180. The first and second subpixel electrodes 191*a* and 191*b* of each of the four adjacent pixels, e.g., a the first pixel PX1, the second pixel PX2, the third pixel PX3, and the fourth pixel PX4, receive the data voltage from the data line 171 through the first and second switching elements Qa and Qb. In the exemplary embodiment shown in FIG. 11, the pixels PX1 and PX4 receive positive (+) data voltage and the pixels PX2 and PX3 receive negative (−) data voltage. In an exemplary embodiment, in which the 1×1 dot inversion driving method is used, the protrusion portion 199 of the second subpixel electrode 191*b* of the pixel PX4 is connected with the connection electrode 174 of the pixel PX1 having the same polarity through the contact hole 189, and the connection electrode 174 overlaps the first subpixel electrode 191*a* with the passivation layer 180 interposed therebetween to form the boost capacitor Cup1.

Although not shown in FIG. 11, the first subpixel electrode 191*a* of other subpixels PX2, PX3, and PX4 may overlaps the connection electrode 174 of the second subpixel electrode 191*b* of the pixel adjacent to the pixels PX2, PX3 and PX4 in the diagonal direction to form the boost capacitor Cup1.

Hereinafter, another alternative exemplary embodiment of a liquid crystal display according to the invention will be described referring to FIG. 13.

Figure 13:
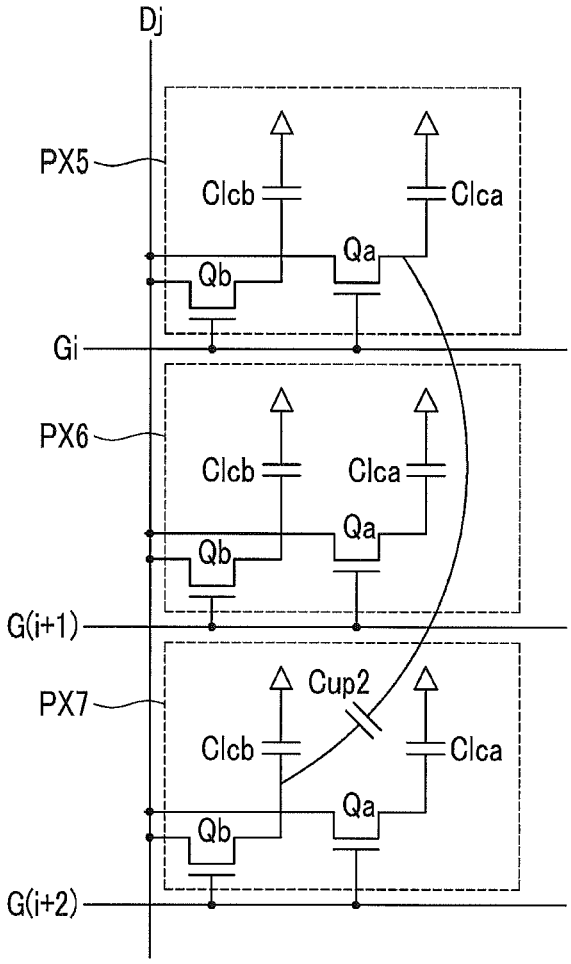
FIG. 13 is an equivalent circuit diagram illustrating three adjacent pixels of an exemplary embodiment of a liquid crystal display according to the invention.

FIG. 13 is an equivalent circuit diagram of three adjacent pixels of an exemplary embodiment of a liquid crystal display according to the invention.

In FIG. 13, three pixels adjacent to each other in a column direction, e.g., a fifth pixel PX5, a sixth pixel PX6 and a seventh pixel PX7, and gate lines, e.g., an i-th gate line Gi, an (i+1)-th gate line G(i+1), and an (i+2)-th gate line G(i+2) connected to the three pixels, respectively, are shown. In an exemplary embodiment, an output terminal of a first switching element Qa of the fifth pixel PX5 overlaps an output terminal of a second switching element of the seventh pixel PX7 connected to the (i+2)-th gate line G(i+2) disposed below by two stages to form a boost capacitor Cup2. In such an embodiment, the polarity of the data voltages applied to the two pixels connected through the boost capacitor Cup2, e.g., the fifth pixel PX5 and the seventh pixel PX7, are substantially the same as each other. In one exemplary embodiment, for example, the liquid crystal display may be driven using a 2×1 dot inversion driving method.

The exemplary embodiments in FIGS. 10 to 13 may have the similar features and aspects of the exemplary embodiment described above.

Further, the auxiliary capacitor Caux shown in the exemplary embodiments of FIGS. 5 to 9 may be further formed in the exemplary embodiments shown in FIGS. 10 to 13.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

What is claimed is:

1. A liquid crystal display, comprising:

a plurality of gate lines including a first gate line;

a plurality of data lines including a first data line crossing the first gate line;

a first switching element connected with the first gate line and the first data line;

a second switching element connected with the first gate line and the first data line;

a first liquid crystal capacitor connected with the first switching element;

a second liquid crystal capacitor connected with the second switching element;

a boost switching element which is directly connected with a data line of the plurality of data lines turned on during a time period not overlapping a time period during which the first switching element is turned on; and a boost capacitor including a first terminal connected with the boost switching element and a second terminal connected with the first liquid crystal capacitor.

2. The liquid crystal display of claim 1, wherein:

the plurality of gate lines further include a second gate line which receives a gate-on voltage when a gate-off voltage is applied to the first gate line, wherein the boost switching element is connected with the second gate line and the first data line.

3. The liquid crystal display of claim 2, further comprising:

an auxiliary capacitor including a third terminal connected with the boost switching element and a fourth terminal which receives a first voltage.

4. The liquid crystal display of claim 3, wherein the first terminal and the third terminal are the same terminal, and the second terminal overlaps the fourth terminal.

5. The liquid crystal display of claim 3, wherein the first terminal is connected to the third terminal and the second terminal and the fourth terminal are disposed in a same layer.

6. The liquid crystal display of claim 5, wherein the first gate line is disposed in the same layer in which the second terminal and the fourth terminal are disposed.

7. The liquid crystal display of claim 2, wherein the boost switching element is connected with a third liquid crystal capacitor.

8. The liquid crystal display of claim 1, further comprising:

an auxiliary capacitor including a third terminal connected with the boost switching element and a fourth terminal which receives a first voltage.

9. The liquid crystal display of claim 8, wherein the first terminal and the third terminal are the same terminal, and the second terminal overlaps the fourth terminal.

10. The liquid crystal display of claim 8, wherein the first terminal is connected to the third terminal and the second terminal and the fourth terminal are disposed in a same layer.

11. The liquid crystal display of claim 10, wherein the first gate line is disposed in the same layer in which the second terminal and the fourth terminal are disposed.

12. The liquid crystal display of claim 1, wherein:

the plurality of gate lines further include a second gate line which receives a gate-on voltage when a gate-off voltage is applied to the first gate line; and the plurality of data lines further include a second data line adjacent to the first data line, wherein the boost switching element is connected with the second gate line and the second data line.

13. The liquid crystal display of claim 12, wherein the boost switching element is connected with a third liquid crystal capacitor.

14. A method for driving a liquid crystal display, the method comprising:

applying a first data voltage to a first liquid crystal capacitor and a second liquid crystal capacitor of the liquid crystal display by turning on a first switching element and the second switching element of the liquid crystal display; and applying a second data voltage having a polarity the same as a polarity of the first data voltage to a first terminal of a boost capacitor of the liquid crystal display by turning on a boost switching element of the liquid crystal display after the first switching element and the second switching element are turned off, wherein the liquid crystal display comprises:

a plurality of gate lines including a first gate line;

a plurality of data lines including a first data line crossing the first gate line;

the first switching element connected with the first gate line and the first data line;

the second switching element connected with the first gate line and the first data line;

the first liquid crystal capacitor connected with the first switching element;

the second liquid crystal capacitor connected with the second switching element;

the boost switching element which is directly connected with a data line of the plurality of data lines; and the boost capacitor including the first terminal connected with the boost switching element and a second terminal connected with the first liquid crystal capacitor.

15. The method of claim 14, wherein the plurality of gate lines further include a second gate line which receives a gate-on voltage when a gate-off voltage is applied to the first gate line; and wherein the boost switching element is connected with the second gate line and the first data line.

16. The method of claim 15, wherein the liquid crystal display further comprises:

an auxiliary capacitor including a third terminal connected with the boost switching element and a fourth terminal which receives a first voltage.

17. The method of claim 15, wherein the boost switching element is connected with a third liquid crystal capacitor.

18. The method of claim 14, wherein the liquid crystal display further comprises:

an auxiliary capacitor including a third terminal connected with the boost switching element and a fourth terminal which receives a first voltage.

19. The method of claim 14, wherein the liquid crystal display further comprises:

a second gate line which receives a gate-on voltage when a gate-off voltage is applied to the first gate line; and a second data line adjacent to the first data line, wherein the boost switching element is connected with the second gate line and the second data line.

20. The method of claim 19, wherein the boost switching element is connected with a third liquid crystal capacitor.

* * * * *